United States Patent [19]

Strempel et al.

[11] Patent Number: 4,508,633

[45] Date of Patent: Apr. 2, 1985

[54] SCOURING POWDER

[75] Inventors: Hans-Jurgen Strempel, Rodgau; Manfred Diehl, Frankfurt; Roland Bergmann, Hanau, all of Fed. Rep. of Germany

[73] Assignee: Degussa Aktiengesellschaft, Frankfurt am Main, Fed. Rep. of Germany

[21] Appl. No.: 440,166

[22] Filed: Nov. 8, 1982

[30] Foreign Application Priority Data

Nov. 7, 1981 [DE] Fed. Rep. of Germany ..... 3144298

[51] Int. Cl.[3] ..... C11D 17/06

[52] U.S. Cl. ..... 252/135; 252/140; 252/174.25

[58] Field of Search ..... 252/129, 131, 135, 140, 252/174.25, 179, 128; 51/308

[56] References Cited

U.S. PATENT DOCUMENTS

| | | | |
|---|---|---|---|
| 4,073,867 | 2/1978 | Roebke et al. | 252/131 |
| 4,222,995 | 9/1980 | Roebke et al. | 252/131 |
| 4,347,153 | 8/1982 | Hooper et al. | 252/128 |

FOREIGN PATENT DOCUMENTS

| | | |
|---|---|---|
| 1810262 | 8/1969 | Fed. Rep. of Germany . |
| 2758202 | 7/1979 | Fed. Rep. of Germany . |
| 2421605 | 12/1979 | France . |
| 1507703 | 4/1978 | United Kingdom . |
| 1517323 | 7/1978 | United Kingdom . |

OTHER PUBLICATIONS

Zeolite Molecular Sieves Structure, Chemistry, and Use, by Donald W. Breck, Jul. 1973, pp. 353 and 388–389, A Wiley-Interscience Publication.

*Primary Examiner*—Paul Lieberman
*Assistant Examiner*—Hoa Van Le
*Attorney, Agent, or Firm*—Cushman, Darby & Cushman

[57] ABSTRACT

A scouring powder is provided which contains as the sole mechanical cleaning component crystalline zeolite powder of Type A having the following particle spectrum:

| Fractions (μ) | Proportions (Weight %) |
|---|---|
| <3 | <15 |
| <5 | <35 |
| <10 | <82 |
| <15 | <96 |
| <20 | up to 100 |

and at least 99.5% by weight of the particles having a diameter below 45 microns. Further components of the scouring power can include water soluble agents aiding the cleaning, bleaching, or disinfecting action.

5 Claims, No Drawings

SCOURING POWDER

BACKGROUND OF THE INVENTION

It is known to add crystalline zeolite powder of Type A as a calcium binding material to scouring powders. These scouring agents contain water insoluble, mechanical cleaning components finely ground minerals such as quartz, feldspar, marble, fluorspar flour, kaolin or pumice (see German OS No. 2516116).

SUMMARY OF THE INVENTION

The present invention is directed to a scouring powder which contains crystalline zeolite powder of Type A as the sole mechanical cleaning component.

In a preferred form there is employed a crystalline zeolite powder of Type A which has a particle size distribution as shown in German AS No. 2447021 and related Roebke application Ser. No. 333,714 filed Dec. 23, 1981. The entire disclosure of the Roebke U.S. application and the German AS No. 2447021 are hereby incorporated by reference and relied upon.

The type A zeolite thus can have at least 99.5 weight % of the particles having a diameter below 45μ and have a particle spectrum as follows:

| Fraction (μ) | Proportion (Weight %) |
|---|---|
| <3 | <15 |
| <5 | <35 |
| <10 | <82 |
| <15 | <96 |
| <20 | <100 |

More preferably 99.9 weight % has a particle diameter below 45μ and most preferably 99.99 weight % has a particle diameter below 45.

A preferred particle spectrum within the particle spectrum given above is:

| Fraction (μ) | Proportion (Weight %) |
|---|---|
| <3 | 4–15 |
| <5 | 11–35 |
| <10 | 50–82 |
| <15 | 70–96 |
| <20 | 93–100 |

The production of this selected zeolite powder of Type A can take place according to German AS No. 2447021 and the above-mentioned Roebke U.S. application Ser. No. 333,714.

The scouring agent can contain the crystalline zeolite powder of Type A in an amount of 5 to 95 weight %.

Besides the mechanical cleaning component the scouring powder contains at least one water soluble agent aiding the cleansing bleaching or disinfecting action. Thus the scouring powder of the invention can contains anionic and/or nonionic and/or zwitter ion surfactants and/or bleaching agent or disinfection agent and water soluble, calcium compound dissolving or calcium complex binding materials.

Anionic, nonionic or zwitter ion surfactants (tensides) belong to the class of water soluble agents aiding cleansing, bleaching or disinfecting action.

The surfactants contain in the molecule at least one hydrophobic organic group and a water soluble causing anionic, zwitter ion or nonionic group. In regard to the hydrophobic group there is usually present an aliphatic hydrocarbon group containing 8–26, preferably 10–22 and especially 12–18 carbon atoms, e.g. octyl, decyl, dodecyl, tetradecyl, hexadecyl, octadecyl or eicosanyl or an alkyl aromatic group having 6–18, preferably 8–16 aliphatic carbon atoms, e.g. hexylphenyl, p-octylphenyl, p-nonylphenyl, p-decylphenyl, p-dodecylphenyl, p-hexadecylphenyl, p-octadecylphenyl, o-nonylphenyl or m-octylphenyl.

As anionic surfactants are usable, e.g., soaps of natural or synthetic, preferably saturated fatty acids, e.g. sodium stearate, sodium palmitate or potassium stearate, in a given case there also can be used soaps of resin or naphthenic acids. Suitable synthetic anionic surfactants are those of the type of sulfonates, sulfates and synthetic carboxylates.

As surfactants of the sulfonate type there are are included for example alkylbenzenesulfonate ($C_9$–$C_{15}$-alkyl), e.g. sodium p-nonylphenylsulfonate, sodium p-decylphenylsulfonate, sodium p-dodecylphenylsulfonate, sodium p-pentadecylphenylsulfonate, mixtures of alkene and hydroxyalkanesulfonates as well as disulfonates as can be obtained for example from monoolefins having terminal or inner double bonds by sulfonating with gaseous sulfur trioxide and subsequent alkaline or acid hydrolysis of the sulfonation product. Furthermore, there are suitable alkanesulfonates which are obtainable from alkanes by sulfochlorination of sulfoxidation and subsequent hydrolysis or neutralization or by addition of bisulfite to olefins. Further usable surfactants of the sulfonate type are the esters of α-sulfo-fatty acids, e.g. the α-sulfonic acids from hydrogenated methyl or ethyl esters of coconut, palm kernel or tallow fatty acids.

Suitable surfactants of the sulfate type are the sulfuric acid monoesters of primary alcohols (e.g. from coconut fatty alcohols, tallow fatty alcohols or oleyl alcohol) and those of secondary alcohols. Furthermore, there are suitable sulfated fatty acid alkandamides, fatty acid monoglycerides, e.g. glycerol monostearate, or reaction products of 1–4 moles of ethylene oxide with primary or secondary fatty alcohols, e.g. stearyl alcohol or alkylphenols, e.g. p-octylphenol or p-nonylphenol.

Further suitable anionic surfactants are the fatty acid esters of amides of hydroxy or aminocarboxylic acids or sulfonic acids, e.g. the fatty acid sarcosides, glycolates, lactates, laurides or isoethionates.

The anionic surfactants can be present in the form of their sodium, potassium and ammonium salts as well as soluble salts of organic bases such as mono, di- or triethanolamine.

As nononic surfactants there are usable addition products of 4–40, preferably 4–20 moles of ethylene oxide to 1 mole of fatty alcohol, e.g. octadecyl alcohol, alkylphenol, e.g. p-octylphenol, p-nonylphenol, p-dodecyl-phenol, fatty acids, e.g. palmitic acid stearic acid or oleic acid, fatty amines, e.g. stearylamine, fatty acid amides, e.g. stearic acid amide or alkanesulfonamides. Especially important are the addition products of 5–16 moles of ethylene oxide to coconut or tallow fatty alcohols, to oleyl alcohol or to secondary alcohols having 8–18, preferably 12–18 carbon atoms as well as to mono or dialkyl phenols having 6–14 carbon atoms in the alkyl groups, e.g. p-octylphenol, p-nonylphenol, o,p-dioctylphenol. o,o-dioctyplhenol. Besides these water soluble nonionics, however, these are also of interest soluble polyglycol ethers having 1–4 ethylene glycol ether groups in the molecule, which are not water soluble or only partially water, especially if they are employed together with water soluble, nonionic or anionic surfactants.

Furthermore there are usable as nonionic surfactants the water soluble 20–250 ethylene glycol ether groups and 10–100 propylene glycol ether group containing addition products of ethylene oxide to polypropylene glycol (=Pluronics), alkylenediaminepolypropylene glycol (=Tetronics) and alkyl polypropylene glycols having 1–10 carbon atoms in the alkyl chain, in which the polypropylene glycol chain functions as hydrophobic group.

Even nonionic surfactants of the type of amine oxides or sulfoxides are usable. The foaming power of the surfactant can be increased or decreased through combinations of suitable types of surfactants; a reduction likewise can be attained by addition of non-surfactant type organic materials.

As foam stabilizers there are suited above all with surfactants of the sulfonate or sulfate type capillary active carboxy or sulfobetaines as well as the above-mentioned nonionics of the alkylolamide type; besides there are proposed for this purpose fatty alcohols or higher terminal diols.

As bleaching and disinfecting agents there are usable the known inorganic or organic compounds supplying $H_2O_2$ or active chlorine in the presence of water.

Of special significance as compounds serving as bleaching agents which supply $H_2O_2$ in water are sodium perborate tetrahydrate ($NaBO_2.H_2O_2.3H_2O$) and the monohydrate ($NaBO_2.H_2O_2$). However, there are also usable other $H_2O_2$ supplying borates, e.g. the perborax $Na_2B_4O_7.4H_2O_2$. These compounds can be partially or completely replaced by other active oxygen carriers, especially by peroxyhydrates such as peroxycarbonate ($Na_2CO_3.1.5H_2O_2$), peroxypyrophosphate, citrate perhydrate, urea $H_2O_2$ or melamine $H_2O_2$ compounds as well as by $H_2O_2$ supplying peracid salts such as caroate ($KHSO_5$), perbenzoate or peroxyphthalate.

These percompounds can be employed together with activators as e.g. tetraacetylethylenediamine or tetraacetyl-glycoluril.

Alakli hypochlorites, e.g. sodium hypochlorite and potassium hypochlorite belong to the inorganic active chlorine compounds which especially can be used in the form of their mixed salts or addition compounds to orthophosphates or to condensed phosphates as for example to pyro and polyphosphates or to alkali silicates, e.g. sodium silicate.

If the washing and washing aid monopersulfate and chloride are contained then there is formed in aqueous solution active chlorine.

These are particularly important as organic active chlorine compounds the N-chloro compounds in which one or two chlorine atoms are bound on one nitrogen atom, in which case preferably the third valence of the nitrogen atom leads to a negative group, especially to a CO or $SO_2$ group. There are included in these compounds dichlorocyanuric acid and trichlorocyanuric acid or their salts, e.g. the sodium and potassium salts, chlorinated alkyl guanides or alkyl giguanides, chlorinated hydantoins and chlorinated melamine.

To the class of water soluble calcium compound dissolving compounds there also belong the above-mentioned acid reacting materials specified for the neutralization of the somewhat alkaline impurities of the aluminium silicate. As complex formers for calcium there are suitable for example the following inorganic or organic compounds which preferably are employed in the form of their sodium salt; pyrophosphate, triphosphate, higher polyphosphates and metaphosphate.

Organic complex forms for calcium are included within the water soluble salts especially the sodium salts of polycarboxylic acids, hydroxycarboxylic acids, aminocarboxylic acids, carboxy alkyl ethers, polyanionic polymers, especially the polymeric carboxylic acids, e.g. polyacrylic acid and the phosphonic acids, e.g. polyvinylphosphonic acid.

Examples of polycarboxylic acids are e.g. maleic acid, methylene malonic acid, citraconic acid, mesaconic acid, itaconic acid, non-cyclic polycarboxylic acids having at least 3 carboxyl groups in the molecule as, e.g. tricarboxylic acid, aconitic acid, ethylene tetracarboxylic acid, 1,2, 3,3-propane-tetracarboxylic acid, 1,1,3,3,5,5-pentane hexacarboxylic acid, hexane-hexacarboxylic acid, cyclic di or polycarboxylic acids, as e.g. cyclopentane tetracarboxylic acid, phthalic acid, terephthalic acid, benzenetri- tetra- or pentacarboxylic acid as well as mellitic acid.

Examples of hydroxymono- or polycarboxylic acids are glycolic acid, lactic acid, maleic acid, tartronic acid, methyl tartronic acid, gluconic acid, glyceric acid, citric acid, tartaric acid, salicylic acid.

Examples of aminocarboxylic acids are iminodi- or triacetic acids hydroxyethyl iminodiacetic acid, ethylene-diamine tetraacetic acid, hydroxyethylethylenediamine tetraacetic acid, diethylenetriamine pentaacetic acid as well as higher homologues which can be produced by polymeriation of a N-aziridylcarboxylic acid derivative e.g. of acetic acid, succinic acid, tricarballylic acid and subsequent saponification, or through condensation of polyamines having a molecular weight of 500 to 10,000 with chloroacetic acid or bromoacetic acid salts.

Examples of carboxy alkyl ethers are 2,2-oxydisuccinic acid and other ether polycarboxylic acids, especially carboxymethyl ether group containing polycarboxylic acids, including the corresponding derivatives of the following polyvalent alcohols or hydroxycarboxylic acids, which can be completely or partially etherified with glycerine, glycols, e.g. ethylene glycol or propylene glycol; di or triglycols, e.g. diethylene glycol, triethylene glycol or dipropylene glycol, glycerine, di or triglycerine, glycerine monomethyl ether, 2,2-dihydroxymethyl propanol, 1, 1,1-trihydroxymethyl ethane, 1,1,1-tri-hydroxymethyl propane, erythritol, pentaerythritol, glycolic acid, lactic acid, tartronic acid, methyl tartronic acid, glyceric acid, erthroic acid, malic acid, citric acid, tartaric acid, trihydroxyglutaric acid, saccharic acid, mucic acid.

There can be used as polymeric carboxylic acids, e.g. the polymierzates of acrylic acid, hydroxyacrylic acid, maleic acid, itaconic acid, mesaconic acid, aconitic acid, methylene malonic acid, citraconic acid and the like. The copolymerization of the above-mentioned carboxylic acids with each other or with ethylenically unsaturated compounds such as ethylene, propylene, isobutylene, vinyl alcohol (prepared indirectly), vinyl methyl ether, furane, acrolein, vinyl acetate, acrylamide, acrylonitrile, methacrylic acid, crotonic acid, etc. as well as e.g. the 1:1 mixed polymerizate of maleic anhydride and ethylene or propylene or furane.

Further polymeric carboxylic acids of the type of the polyhydroxypolycarboxylic acids or polyaldehydopolycarboxylic acid are essentially materials built of acrylic acid or acrolein units or acrylic acid and vinyl alcohol units which are obtainable by copolymerization of acrylic acid and acrolein or by polymeiztion of acrolein and subsequent Cannizzaro reaction, in a given case in the presence of formaldehyde.

Examples of phosphorus containing organic complex formers are alkanophosphonic acids, amino- and hydroxyalkanepolyphosphonic acids and phosphonocarboxylic acids, as e.g. the compounds methanediphosphonic acid, propane-1,2,2-triphosphonic acid, butane-1,2,3,4-tetraphosphonic acid, polyvinyl phosphonic acid, 1-aminoethane-1,1-diphosphonic acid, 1-amino-1-phenyl-1,1-diphosphonic acid, aminotrimethylenetriphosphonic acid, methylamino- or ethyleneaminodimethylene-diphosphonic acid, 1-hydroxyethane-1,1-diphosphonic acid, hydroxymethanediphosphonic acid, phosphonoacetic acid, phosphonopropionic acid, 1-phosphonoethane-1,2-dicarboxylic acid, 2-phosphonopropane-2,3-dicarboxylic acid, 2-phosphonobutane-1, 2,4-tricarboxylic acid, 2-phosphonobutane-2,3,4-tricarboxylic acid as well as mixed polymerizates of vinyl phosphonic acid and acrylic acid.

As mechanically acting cleansing agents there can additionally be employed known abrasive components such as quartz, feldspar, marble, fluorite meal, kaolin or pumice. In comparison to known scouring agents the scouring agent of the invention is a mild scouring agent with which a particularly nice cleaning is obtained. Furthermore it is of advantage that the scouring agent of the invention contains no phosphate.

Unless otherwise indicated all parts and percentages are by weight.

The composition can comprise consist essentially of or consist of the stated materials.

DETAILED DESCRIPTION

There are produced three scouring agents by spray mixing. The solid materials wwere present, the surfactant diluted with water was subsequently mixed in and sprayed. Then it was made into a powder with 50% of the HAB A 100, through which the powder properties of the product were noticeably improved.

HAB A 100 is a powdery zeolite of type A produced according to German OS No. 2447021 and the abovementioned Roebke U.S. application Ser. No. 333,714.

ABS is a sodium higher alkylbenzene sulfonate. The nonionic surfactant used was an ethoxylated fatty alcohol.

Sicalon is sprayed dried waterglass.

| Recipe 1 | |
|---|---|
| HAB A 100 | 52% |
| ABS | 6% |
| Nonionic surfactant(1) | 3% |
| Sicalon ® | 6.5% |
| Soda | 6.5% |
| Sodium perborate | 4% |
| $Na_2BO_2l$ | 18% |
| $H_2O$ | 4% |
| Bulk density: 492 g/l | |

-continued

| Recipe 2 | |
|---|---|
| HAB A 100 | 50% |
| ABS | 4% |
| Nonionic surfactant(2) | 2% |
| Sicalon ® | 8% |
| Soda | 6% |
| $Na_2SO_4$ | 20% |
| $H_2O$ | 4% |
| Bulk density: 486/gl | |

| Recipe 3 | |
|---|---|
| HAB A 100 | 90% |
| Nonionic surfactant(3) | 2.5% |
| $H_2O$ | 7.5% |
| Bulk density: 390 g/l | |

| Abrasivity Measurements: | |
|---|---|
| HAB A 100 | 29.9 mg Acrylglas |
| Fixit | 012.5 mg Acrylglas |
| Ajar | 85.9 mg Acrylglas |
| ATA | 106.1 mg Acrylglas |

(1)Fatty alcohol with 16–18 carbon atoms and methylene oxide groups.
(2)Tallow alcohol with 5 ethylene oxide groups
(3)Nonylphenyl with ethylene oxide groups

COMMENTS

Recipe 1 because of the presence of the perborate is not suited for cleaning bleach or aluminium pots. Therefore Recipe 2 is well suited to clean this type of apparatus.

The use of Recipe 1 is chiefly related to cleaning stainless steel, chromium, tile, fleeces and water closets.

The entire disclosure of German priority application No. P 3144298.6 is hereby incorporated by reference.

What is claimed is:

1. A process of scouring comprising scouring with scouring powder containing crystalline zeolite powder of Type A as the sole mechanical cleaning component, said zeolite having the following particle spectrum:

| Fractions (μ) | Proportions (Weight %) |
|---|---|
| <3 | <15 |
| <5 | <35 |
| <10 | <82 |
| <15 | <96 |
| <20 | up to 100 |

and at least 99.5% by weight of the particles have a diameter below 45 microns.

2. A process according to claim 1 including in the scouring powder another compound having cleansing, bleaching or disinfecting action.

3. A process according to claim 1 including in the scouring powder at least one member of the group consisting of anionic, nonionic and zwitter ion surfactants, a bleaching agent, a disinfecting agent, a water soluble compound which dissolves calcium or a material which forms a complex with calcium.

4. A process according to claim 1 wherein there is scoured aluminum pots, stainless steel, tile, or water closets.

5. A process according to claim 4 wherein the scouring powder contains 5 to 95% of the crystalline zeolite of Type A.

* * * * *